US006685487B2

(12) United States Patent
Ward et al.

(10) Patent No.: US 6,685,487 B2
(45) Date of Patent: Feb. 3, 2004

(54) ELASTOMERIC CONNECTOR ASSEMBLY

(75) Inventors: Isaac Ward, Queenscliff (AU); Dietmar F. Wennemer, San Diego, CA (US)

(73) Assignee: Siemens Information & Communication Mobile LLC, San Diego, CA (US)

( * ) Notice: Subject to any disclaimer, the term of this patent is extended or adjusted under 35 U.S.C. 154(b) by 0 days.

(21) Appl. No.: 10/170,787

(22) Filed: Jun. 12, 2002

(65) Prior Publication Data

US 2003/0232525 A1 Dec. 18, 2003

(51) Int. Cl.[7] ..... H01R 4/58
(52) U.S. Cl. ..... 439/91; 439/66
(58) Field of Search ..... 439/90, 91, 66, 439/591, 86

(56) References Cited

U.S. PATENT DOCUMENTS 5,613,862 A * 3/1997 Naylor ..... 439/91

6,091,475 A * 7/2000 Ogino et al. ..... 439/86

* cited by examiner

*Primary Examiner*—Tho D. Ta

(57) ABSTRACT

An elastomeric connector assembly for electrically coupling electronic components comprises a first contact member extending from a surface of a first electronic component in a generally vertical plane for providing electrical connection to the first electronic component and a second contact member extending from a surface of a second electronic component in a generally vertical plane for providing electrical connection to the second electronic component. An elastomeric connector is disposed between the first contact member and the second contact member in a generally horizontal plane. The elastomeric connector couples the first contact member and the second contact member for providing an electrical connection between the first and second electronic components.

36 Claims, 3 Drawing Sheets

ELASTOMERIC CONNECTOR ASSEMBLY

BACKGROUND OF THE INVENTION

The present invention relates generally to elastomeric connector assemblies used for electrically connecting components such as printed circuit boards (PCBs), liquid crystal displays (LCDs), and the like, in an electronic device, and more particularly, to an elastomeric connector assembly having an elastomeric connector mounted in a generally horizontal plane between two or more contact members extending from the electronic components in a substantially vertical plane.

Traditional elastomeric connector assemblies consist of an elastomeric connector mounted in a vertical orientation between contacts horizontally disposed on the surface of the electronic components being interconnected. These contacts are then forced together, compressing the elastomeric connector to provide electrical connection of the components. FIGS. 1 through 3 illustrate the basic construction of a traditional elastomeric connector assembly 100. The elastomeric connector assembly 100 consists of an elastomeric connector 102 compressed between electronic components, in this case, a printed circuit board (PCB) 104 and a liquid crystal display (LCD) 106. The elastomeric connector 102 is fabricated of a resilient, elastomeric material having layered connector elements 108 extending therethrough for electrically coupling contacts 110 formed on the surfaces of electronic components 104 and 106. In this manner, electrical connection of the electronic components 104 and 106 is achieved.

Compression of the elastomeric connector 102 is required to ensure a low contact resistivity between the layered connector elements 108 of the elastomeric connector 102 and the contacts 110. As shown in FIG. 2, the electronic components 104 and 106 exert a force ($F_1$) on the elastomeric connector 102 in a vertical plane (i.e., in a plane normal to the surfaces of the components), compressing the elastomeric material. In turn, the elastomeric connector 102 applies an opposite force ($F_2$) against the electronic components 104 and 106, promoting separation and/or bending of the components in the vertical plane (i.e., in a plane normal to the surfaces of the electronic components 104 and 106). However, if the force ($F_2$) exerted on the contacts 110 is reduced, the elastomeric material relaxes, increasing contact resistivity so that a reliable electrical connection may no longer be available. This reduction in force ($F_2$) can be caused by stretch, i.e., relaxation over time of plastic materials used in the supporting structure 112 applying the force ($F_1$), or by shifting of the electronic components 104 and 106 and supporting structure 112 due to mechanical shock.

Compression of the elastomeric connector 102 also requires the use of additional supporting structure, e.g., a metal support frame 114, for clamping the electronic components 104 and 106 together. Use of the additional supporting structure increases manufacturing costs. This supporting structure increases the height or thickness (H) of the assembly, and thus increases the minimum thickness of the electronic device in which the elastomeric connector assembly 100 is used. As electronic consumer devices become smaller, increased thicknesses of assemblies within devices is not desirable.

Moreover, electronic devices are usually assembled vertically for convenience of manufacturing, generating a level of error requiring the use of greater tolerances in the vertical plane. Consequently, shifts in the vertical alignment of electronic components are common. As shown in FIG. 3, such problems are exacerbated by the use of traditional elastomeric connector assemblies 100. Compression of the elastomeric connector 102 applies a force ($F_2$) on supporting structure 112 for the electronic components 104 and 106 that acts in a direction parallel to the tolerance stack up (represented by maximum vertical tolerance $T_V$). As a result, stringent vertical tolerances are required for maintaining adequate contact between the elastomeric connector 102 and contacts 110, thereby increasing the cost of manufacturing the electronic device in which the elastomeric connector assembly 100 is used.

Consequently, it is desirable to provide an elastomeric connector assembly that does not require the elastomeric connector to be compressed in the vertical plane of the components it interconnects (i.e., in a plane normal to the surfaces of the electronic components) to achieve good electrical connection.

SUMMARY OF THE INVENTION

The present invention is directed to an elastomeric connector assembly suitable for electrically coupling components such as printed circuit boards (PCBs), liquid crystal displays (LCDs), and the like, in an electronic device. The elastomeric connector assembly comprises an elastomeric connector mounted in a generally horizontal plane (i.e., a plane generally parallel to the surface of one or both of the electronic components) between two or more contact members extending from the electronic components in a substantially vertical plane (i.e., a plane generally normal to the surfaces of the electrical components).

According to a specific embodiment, the present invention provides an elastomeric connector assembly including a first contact member extending from a surface of a first electronic component for providing electrical connection to the first electronic component and a second contact member extending from a surface of a second electronic component for providing electrical connection to the second electronic component. An elastomeric connector is disposed between the first contact member and the second contact member in a generally horizontal plane (i.e., a plane generally parallel to the surface of one or both of the first and second electronic components). The elastomeric connector couples the first contact member and the second contact member for providing an electrical connection between the first and second electronic components.

According to a second specific embodiment, the present invention provides an electronic device employing an elastomeric connector assembly. The electronic device includes a first electronic component and a second electronic component electrically interconnected by the elastomeric connector assembly. The elastomeric connector assembly includes a first contact member extending from a surface of the first electronic component for providing electrical connection to the first electronic component and a second contact member extending from a surface of the second electronic component for providing electrical connection to the second electronic component. An elastomeric connector is disposed between the first contact member and the second contact member a generally horizontal plane (i.e., a plane generally parallel to the surface of one or both of the first and second electronic components) for electrically coupling the first contact member and the second contact member.

It is to be understood that both the foregoing general description and the following detailed description are exemplary and explanatory only and are not necessarily restrictive of the invention claimed. The accompanying drawings, which are incorporated in and constitute a part of the specification, illustrate embodiments of the invention and together with the general description, serve to explain the principles of the invention.

DETAILED DESCRIPTION OF SPECIFIC EMBODIMENTS

Reference will now be made in detail to the presently preferred embodiments of the invention, examples of which are illustrated in the accompanying drawings.

Figure 4:
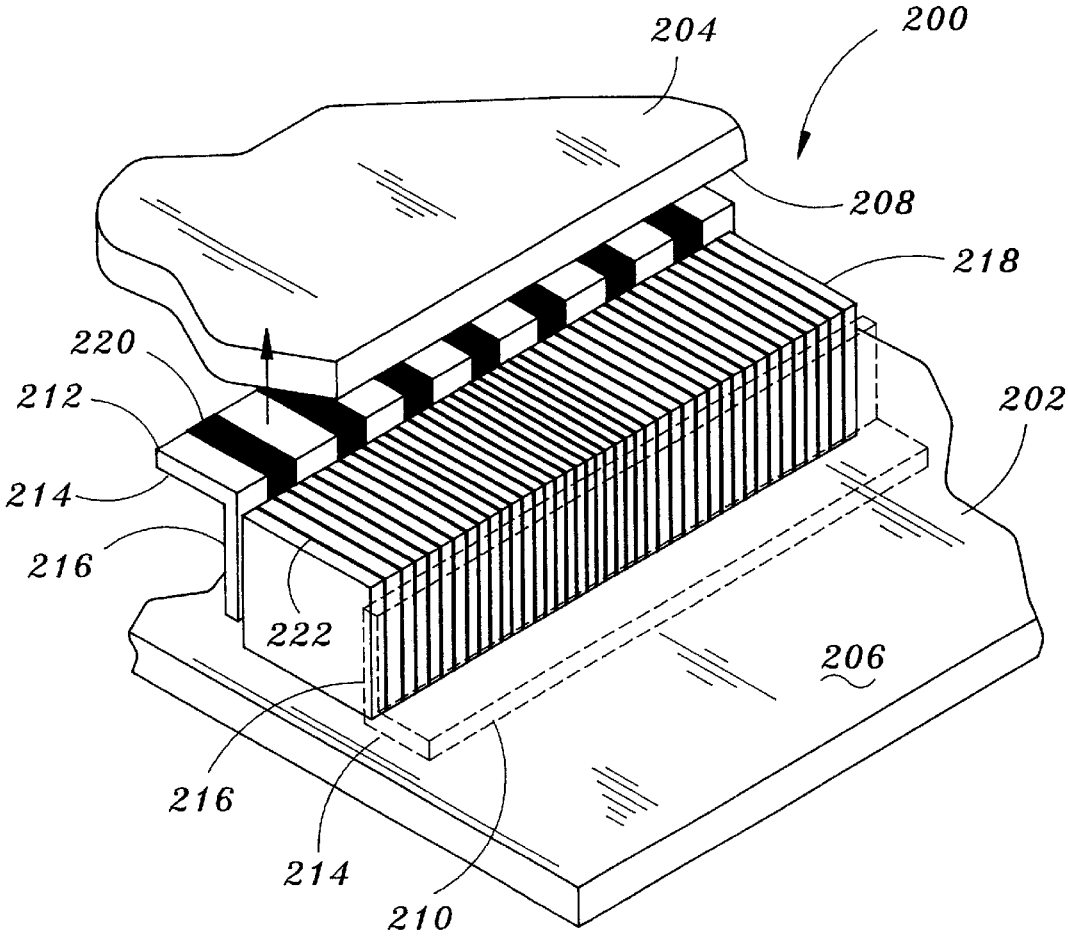
FIG. 4 is an isometric view illustrating an elastomeric connector assembly in accordance with an exemplary embodiment of the present invention.
Figure 5:
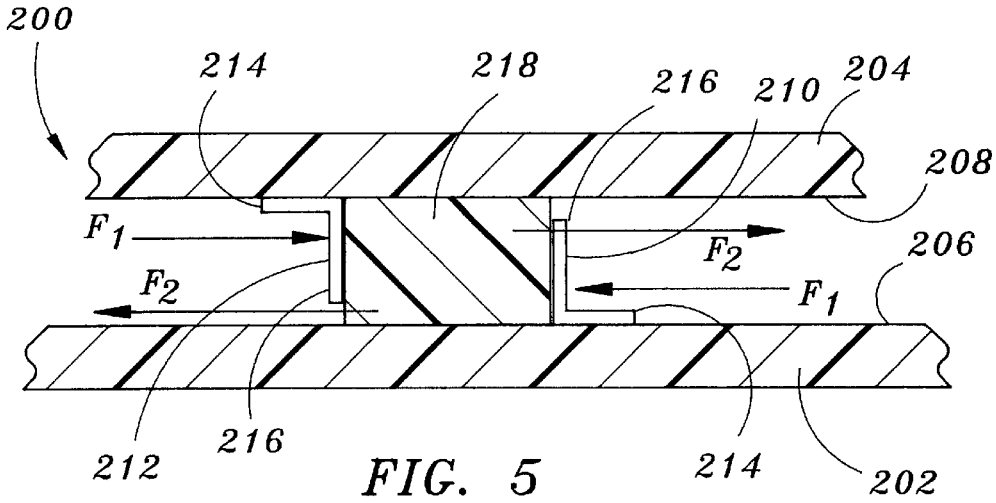
FIG. 5 is a cross-sectional side elevation view of the elastomeric connector assembly shown in FIG. 4.

FIGS. 4 and 5 illustrate an exemplary elastomeric connector assembly 200 in accordance with a specific embodiment of the present invention. The elastomeric connector assembly 200 is suitable for electrically interconnecting two electronic components 202 and 204 having surfaces 206 and 208 held in a generally parallel, spaced apart relationship. As shown in FIGS. 4 and 5, the elastomeric connector assembly 200 includes a first contact member 210 coupled to the first electronic component 202 and a second contact member 212 coupled to the second electronic component 204. In the embodiment illustrated, contact members 210 and 212 comprise rigid, generally L-shaped members including a base portion 214 attached to the surface 206 or 208 of the electronic component 202 or 204 and a contact support portion 216 extending from the surface 206 or 208 in a generally vertical plane (i.e., a plane generally normal or perpendicular to one or both of the surfaces 206 and 208). However, it is contemplated that the contact members 210 and 212 may have other cross-sectional shapes (e.g., square, triangular, etc.) or may include bracing for providing the contact members 210 and 212 with additional structural rigidity.

An elastomeric connector 218 is disposed between the first contact member 210 and the second contact member 212 in a generally horizontal plane (i.e., in a plane generally parallel to one or both of the surfaces 206 and 208 of the first and second electronic components 202 and 204). The elastomeric connector 218 electrically couples the first contact member 210 and the second contact member 212 for providing an electrical connection between the first and second electronic components 202 and 204. Preferably, contact members 210 and 212 may be allowed to move or float in the vertical plane relative to one another, and/or relative to elastomeric connector 218 while maintaining adequate electrical connection with the elastomeric connector 218.

In the exemplary embodiment illustrated in FIG. 4, the first and second contact members 210 and 212 each comprise a plurality of generally parallel contact elements 220 formed of a suitable material such as copper, gold, silver, or the like, on the surface of the contact support portion 216. These contact elements 220 are soldered or bonded to the electronic component 202 or 204 to provide electrical connection to the electronic component 202 or 204. The elastomeric connector 218 is formed of a resilient material having a plurality of connector elements 222 extending therethrough. In embodiments of the invention, the connector elements 222 comprise layers or paths formed of a suitable conductive material such as copper, gold, silver, aluminum, carbon impregnated silicone, silver impregnated silicone, or the like, laminated within an electrically insulating material such as silicone, vinyl, rubber, or the like. Preferably, the contact elements 220 on each contact member 210 and 212 are positioned to be electrically connected by one or more connector elements 222 completing an electrical circuit between contact elements 220 for electrically coupling the first contact member 210 and the second contact member 212.

Elastomeric connector 218 may be compressed between the first contact member 210 and the second contact member 212 to provide a low contact resistivity between the connector elements 222 of the elastomeric connector 218 and the contact elements 220 of contact members 210 and 212. As shown in FIG. 5, the electronic components 202 and 204 exert a force ($F_1$) on the elastomeric connector 218 in a generally horizontal plane (i.e., in a plane generally parallel to one or both surfaces 206 and 208 of the electronic components 202 and 204) through the contact members 210 and 212, compressing the elastomeric material. The elastomeric connector 218 applies an opposite force ($F_2$) against the contact members 210 and 212, providing a positive contact between the connector elements 222 and the contact elements 220. By mounting and compressing the elastomeric connector 218 in the horizontal plane, it becomes possible to reduce or eliminate forces applied to the elastomeric connector 218 in the vertical plane, or, alternately, to reduce the cross-sectional area over which such forces are applied. In this manner, deflection in the electronic components 202 and 204 is reduced or eliminated, minimizing the possibility of failure of the elastomeric connector assembly 200 due to bending, fatigue, or the like.

Elastomeric connector assemblies 200 in accordance with the present invention may be used to electrically interconnect a variety of electronic components 202 and 204. For example, in one application, the elastomeric connector assembly 200 may be used in display assemblies employing a liquid crystal display (LCD), an electroflorescent display, a piezoelectric display, or the like. In this application, the first electronic component 202 comprises a printed circuit board (PCB), while the, second electronic component 204 comprises the display. In a second application, the elastomeric connector assembly 200 may be used to interconnect nested printed circuit boards (PCBs). In this application, the first and second electronic components 202 and 204 each comprise printed circuit boards (PCBs). In yet another application, the elastomeric connector assembly 200 may be utilized to couple a chip carrier to a printed circuit board (PCB). In this application, the first electronic component 202 comprises a printed circuit board (PCB) and the second electronic component 204 comprises the chip carrier. Based on the present disclosure, it is contemplated that one of skill in the art may devise other applications employing elastomeric connector assemblies 200 in accordance with the present invention. Accordingly, use of the elastomeric connector assemblies 200 of the present invention in such applications would not depart from the scope and spirit of the present invention.

Figure 6:
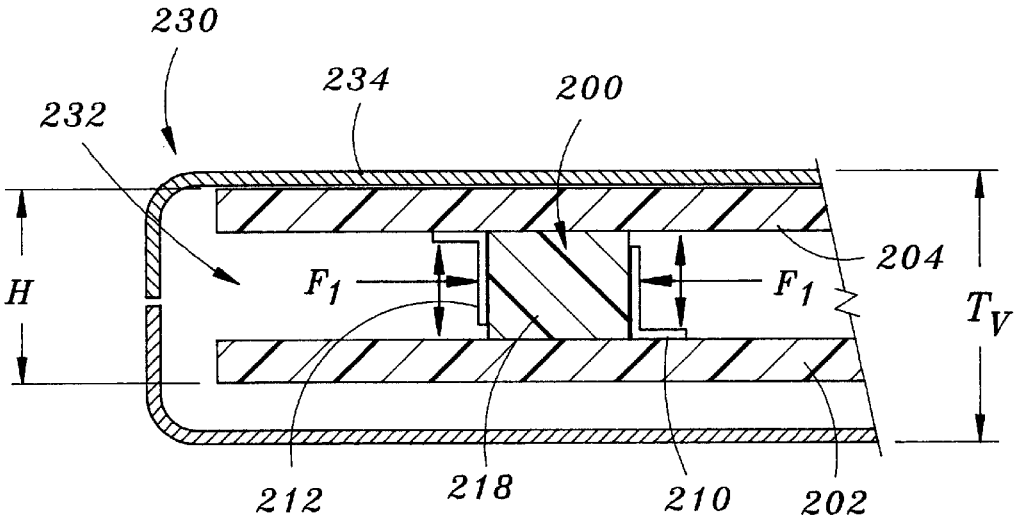
FIG. 6 is a cross-sectional side elevation view of the elastomeric connector assembly shown in FIG. 4, wherein the elastomeric connector assembly is assembled into an electronic device.

Referring now to FIG. 6, a hand-held electronic device 230 employing an elastomeric connector assembly 200 in accordance with the present invention is described. The electronic device 230 comprises a small, hand-held consumer device such as a mobile telephone handset, a cellular telephone, a hand-held computer, or the like, employing a liquid crystal display (LCD) assembly 232 for displaying information to a user of the device. In such embodiments, the elastomeric connector assembly 200 may be utilized in the liquid crystal display (LCD) assembly 232 for electrically interconnecting electronic components 202 and 204 comprising a printed circuit board (PCB) and a liquid crystal display (LCD), respectively. However, it is also contemplated that elastomeric connector assemblies 200 in accordance with the present invention may also be used to electrically interconnect other components of the electronic device 230 (e.g., nested printed circuit boards (PCBs), chip carriers, or the like) without departing from the scope and spirit of the present invention.

As shown in FIG. 6, the liquid crystal display (LCD) assembly 232 is enclosed in a housing 234 that provides horizontal alignment of the electronic components 202 and 204 for controlling compression of the elastomeric connector 218. Thus, rather than being sandwiched in a vertical plane by supporting structure as in prior art elastomeric connector assemblies, the elastomeric connector 218 of the present invention is compressed in the horizontal plane between generally vertical contact members 210 and 212. Consequently, the contact members 210 and 212 may be allowed to move or float in the vertical plane relative to one another, and/or relative to the elastomeric connector 218, while maintaining adequate electrical connection with the elastomeric connector 218. Thus, the electronic components 202 and 204 may also be allowed to move relative to one another in the vertical plane, for example, due to manufacturing variations in the housing 234, or the like. In this manner, the component tolerances in the vertical plane (represented by maximum vertical tolerance $T_V$) may be relaxed since stringent vertical tolerances are no longer required to maintain adequate contact between the elastomeric connector 218 and the contact members 210 and 212. In this manner, components of the electronic device 230 may be manufactured at a lower cost. Additionally, where the electronic device 230 is assembled in the vertical plane, alignment of the electronic components 202 and 204 in the horizontal plane is more easily controlled since horizontal alignment is less dependent on proper component assembly. Thus, alignment of electronic components 202 and 204 may be more readily achieved through efficient design of the housing 234.

Figure 1:
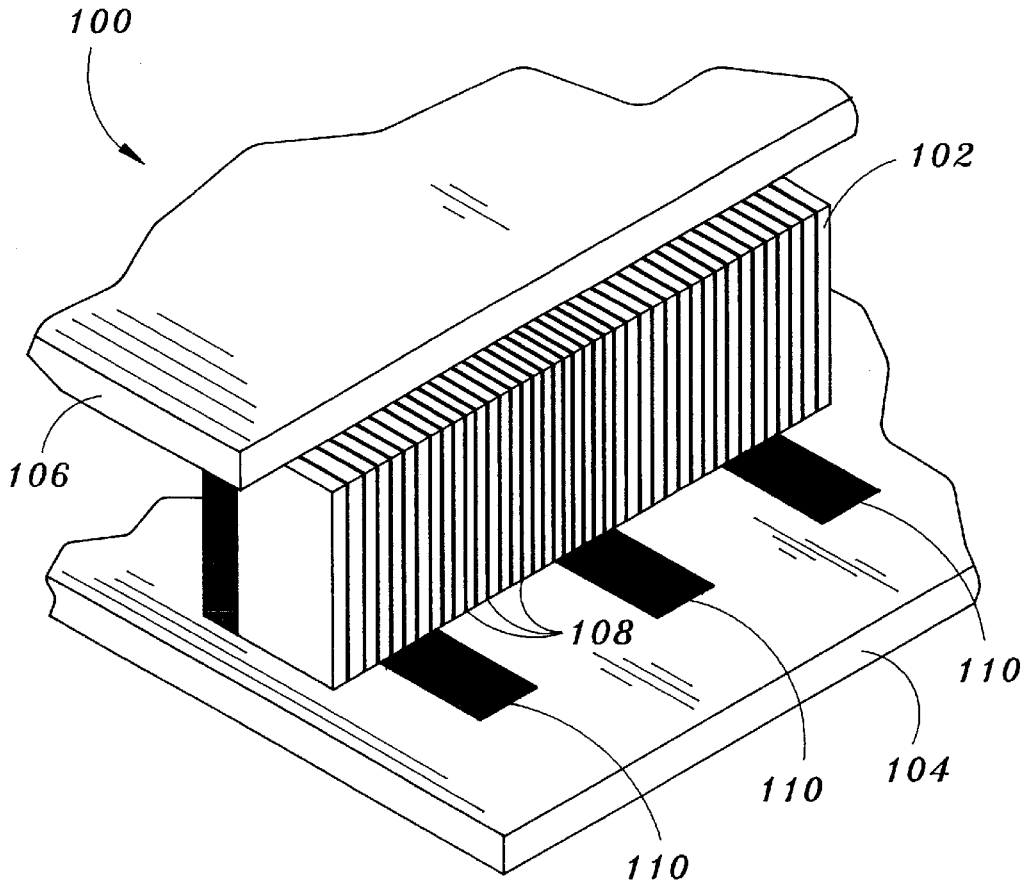
FIG. 1 (PRIOR ART)
FIG. 1 is an isometric view illustrating an elastomeric connector assembly in accordance with the prior art.
Figure 2:
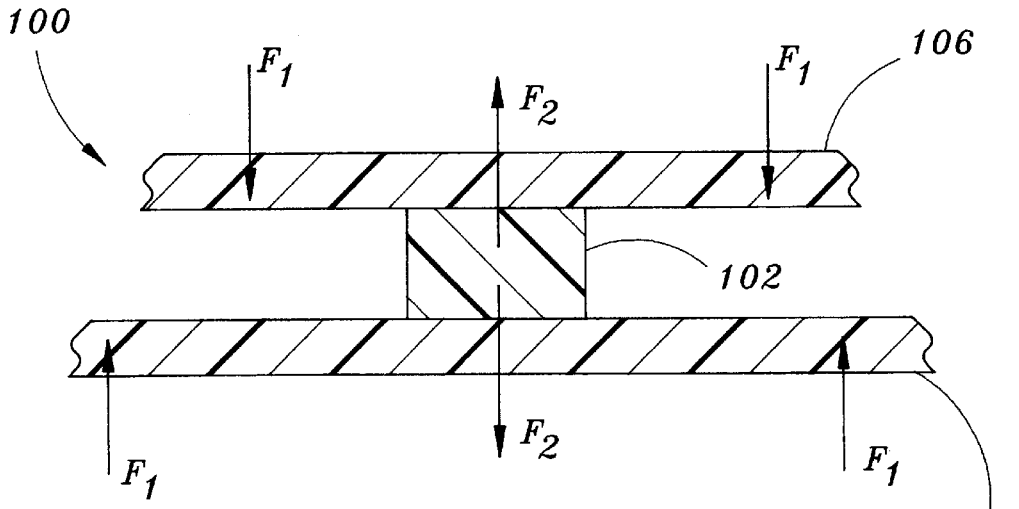
FIG. 2 (PRIOR ART)
FIG. 2 is a cross-sectional side elevation view of the elastomeric connector assembly shown in FIG. 1.
Figure 3:
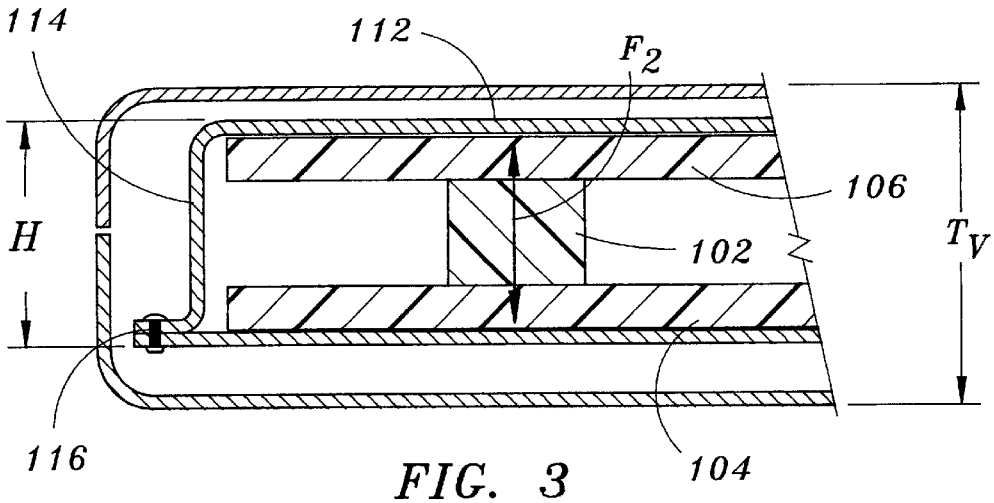
FIG. 3 (PRIOR ART)
FIG. 3 is a cross-sectional side elevation view of the elastomeric connector assembly shown in FIG. 1, wherein the elastomeric connector assembly is assembled into an electronic device.

Comparing FIGS. 3 and 6, it can be seen that elastomeric connector assemblies 200 in accordance with the present invention also require less supporting structure than do conventional elastomeric connector assemblies 100. As shown in FIG. 3, compression of the elastomeric connector 102 of conventional elastomeric connector assemblies 100 requires the use of supporting structure 112 for clamping electronic components 104 and 106 together. Typically, this supporting structure 112 consists of a metal support frame 114 secured via a plurality of screws or snaps 116. Because the elastomeric connector assembly 200 of the present invention does not require compression in the vertical plane, metal support frame 114 can be eliminated, reducing the height (H) of the assembly 232. In this manner, the size and weight of the electronic device 230 can be reduced. Further, because internal supporting structure 112 is eliminated or simplified, the cost of the electronic device 230 may be reduced and the time required for its assembly shortened. Moreover, it becomes possible to employ the elastomeric connector assembly 200 in applications where prior art elastomeric connector assemblies 100 could not be used, for example, because supporting structure 112 could not be provided that furnished adequate compression of the elastomeric connector 102 in the vertical plane.

Figure 7:
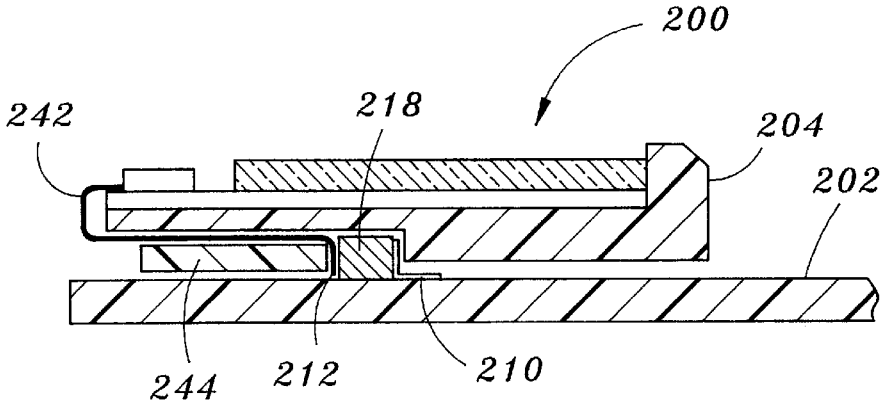
FIG. 7 is a cross-sectional side elevation view of a liquid crystal display (LCD) assembly employing an elastomeric connector assembly in accordance with the present invention, wherein at least one contact member of the elastomeric assembly comprises a flexible circuit.

FIG. 7 depicts an exemplary elastomeric connector assembly 200 in accordance with a second exemplary embodiment of the present invention. In this embodiment, the elastomeric connector 218 is mounted in a horizontal plane between first and second contact members 210 and 212. The first contact member 210 is comprised of a rigid, L-shaped member bonded or soldered to the first electronic component 202, which in the embodiment shown, comprises a printed circuit board (PCB). However, the second contact member 212 comprises a flexible circuit or ribbon cable 242 coupled to the second electronic component 204, a liquid crystal display (LCD). A support 244 is provided adjacent to the first contact member 212. The support 244 provides shape to the second contact member 212 and supports the contact member 212 in a generally vertical plane so that the elastomeric connector 218 may be compressed between the second contact member 212 and the first contact member 210. Like the elastomeric connector assemblies 200 of the embodiments illustrated in FIGS. 4 through 6, the elastomeric connector assembly 200 shown in FIG. 7 may be utilized in an electronic device, such as the electronic device 230 shown in FIG. 6, for electrically interconnecting components of the device.

Based on the foregoing description, it will be appreciated by those of skill in the art that the elastomeric connector assemblies 200 of the present invention may be mounted within an electronic device 230 in any orientation. Thus, as utilized herein, the terms "horizontal" and "horizontal plane" refers to a plane that is generally parallel to one or both of surfaces 206 and 208 while the terms "vertical" and "vertical plane" refers to a plane that is generally perpendicular or normal to one or both of the surfaces 206 and 208.

It is believed that the present invention and many of its attendant advantages will be understood by the foregoing description, and it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. An elastomeric connector assembly, comprising:

a first contact member having a first base portion substantially parallel to and disposed on a surface of a first electronic component and having a first contact portion substantially perpendicular to said surface of said first electronic component, said first contact member for providing electrical connection to the first electronic component;

a second contact member having a second base portion substantially parallel to and disposed on a surface of a second electronic component and having a second contact portion substantially perpendicular to said surface of said second electronic component, said second contact member for providing electrical connection to the second electronic component; and an elastomeric connector disposed between the first contact portion of said first contact member and the second contact portion of said second contact member in a plane generally parallel to the surface of at least one of the first electronic component and the second electronic component, wherein said elastomeric connector is disposed between said first contact member and said second contact member such that the first base portion and the second base portion are substantially parallel but offset in relation to each other, wherein the elastomeric connector couples the first contact portion of said first contact member and the second contact portion second contact member for providing an electrical connection between the first and second electronic components.

2. The elastomeric connector assembly as claimed in claim 1, wherein the elastomeric connector is compressed between the first contact member and the second contact member.

3. The elastomeric connector assembly as claimed in claim 1, wherein the first contact member and the second contact member are rigid.

4. The elastomeric connector assembly as claimed in claim 1, wherein the first electronic component comprises a printed circuit board (PCB) and the second electronic component comprises one of a liquid crystal display (LCD), an electroflorescent display and a piezoelectric display.

5. The elastomeric connector assembly as claimed in claim 1, wherein the first and second electronic components comprise printed circuit boards (PCBs).

6. The elastomeric connector assembly as claimed in claim 1, wherein the first electronic component comprises a printed circuit board (PCB) and the second electronic component comprises a chip carrier.

7. The elastomeric connector assembly as claimed in claim 1, wherein the elastomeric connector is compressed between the first contact member and the second contact member along the plane generally parallel to the surface of at least one of the first electronic component and the second electronic component.

8. The elastomeric connector assembly as claimed in claim 1, wherein the elastomeric connector comprises a resilient material having a plurality of connector elements extending there through for electrically coupling the first contact member and the second contact member.

9. The elastomeric connector assembly as claimed in claim 8, wherein the first contact member comprises a first contact element electrically coupled to the first electronic component and the second contact member comprises a second contact element electrically coupled to the second electronic component, the first contact element and second contact element being positioned to be electrically connected by a connector element of the elastomeric connector.

10. The elastomeric connector assembly as claimed in claim 8, wherein the resilient material comprises silicone and the plurality of connector elements comprise one of carbon, silver, and gold.

11. The elastomeric connector assembly as claimed in claim 1, wherein at least one of the first contact member and the second contact member comprises a flexible circuit.

12. The elastomeric connector assembly as claimed in claim 11, further comprising a support for supporting the flexible circuit.

13. An electronic device, comprising:

a first electronic component;

a second electronic component; and an elastomeric connector assembly, including:

a first contact member having a first base portion substantially parallel to and disposed on a surface of the first electronic component and having a first contact portion substantially perpendicular to said surface of said first electronic component, said first contact member for providing electrical connection to the first electronic component;

a second contact member having a second base portion substantially parallel to and disposed on a surface of the second electronic component and having a second contact portion substantially perpendicular to said surface of said second electronic component, said second contact member for providing electrical connection to the second electronic component; and an elastomeric connector disposed between the first contact portion of said first contact member and the second contact portion of said second contact member in a plane generally parallel to the surface of at least one of the first electronic component and the second electronic component for electrically coupling the first contact member and the second contact member, wherein said elastomeric connector is disposed between said first contact member and said second contact member such that said first base portion and said second base portion are substantially parallel but offset in relation to each other;

wherein the elastomeric connector assembly provides electrical connection between the first and second electronic components.

14. The electronic device as claimed in claim 13, wherein the elastomeric connector is compressed between the first contact member and the second contact member.

15. The electronic device as claimed in claim 13, wherein the first contact member and the second contact member are rigid.

16. The electronic device as claimed in claim 13, wherein the first electronic component comprises a printed circuit board (PCB) and the second electronic component comprises one of a liquid crystal display (LCD), an electroflorescent display and a piezoelectric display.

17. The electronic device as claimed in claim 13, wherein the first and second electronic components comprise printed circuit boards (PCB).

18. The electronic device as claimed in claim 13, wherein the first electronic component comprises a printed circuit board (PCB) and the second electronic component comprises a chip carrier.

19. The electronic device as claimed in claim 13, wherein the elastomeric connector comprises a resilient material having a plurality of connector elements extending there through for electrically coupling the first contact member and the second contact member.

20. The electronic device as claimed in claim 13, wherein the elastomeric connector is compressed between the first contact member and the second contact member along the plane generally parallel to the surface of at least one of the first electronic component and the second electronic component.

21. The electronic device as claimed in claim 19, wherein the first contact member comprises a contact element electrically coupled to the first electronic component and the second contact member comprises a second contact element electrically coupled to the second electronic component, the first contact element and second contact element being positioned to be electrically connected by a connector element.

22. The electronic device as claimed in claim 19, wherein the resilient material comprises silicone and the plurality of connector elements comprise one of carbon, silver, and gold.

23. The electronic device as claimed in claim 13, wherein at least one of the first contact member and the second contact member comprises a flexible circuit.

24. The electronic device as claimed in claim 23, further comprising a support for supporting the flexible circuit.

25. An elastomeric connector assembly, comprising:

a first contact member having a first portion extending from a surface of a first electronic component in a first plane generally vertical to said surface of said first electronic component, said first contact member for providing electrical connection to the first electronic component;

a second contact member having a second portion extending from a surface of a second electronic component in a second plane generally vertical to said surface of said second electronic component, said second contact member for providing electrical connection to the second electronic component; and an elastomeric connector disposed between the first contact member and the second contact member such that the first portion and the second portion are not coplanar, wherein the elastomeric connector couples the first contact member and the second contact member for providing an electrical connection between the first and second electronic components.

26. The elastomeric connector assembly as claimed in claim 25, wherein the elastomeric connector is compressed between the first contact member and the second contact member.

27. The elastomeric connector assembly as claimed in claim 25, wherein the first contact member and the second contact member are rigid.

28. The elastomeric connector assembly as claimed in claim 25, wherein the first electronic component comprises a printed circuit board (PCB) and the second electronic component comprises one of a liquid crystal display (LCD), an electroflorescent display and a piezoelectric display.

29. The elastomeric connector assembly as claimed in claim 25, wherein the first and second electronic components comprise printed circuit boards (PCBs).

30. The elastomeric connector assembly as claimed in claim 25, wherein the first electronic component comprises a printed circuit board (PCB) and the second electronic component comprises a chip carrier.

31. The elastomeric connector assembly as claimed in claim 25, wherein the elastomeric connector is compressed between the first contact member and the second contact member along the generally horizontal plane.

32. The elastomeric connector assembly as claimed in claim 25, wherein the elastomeric connector comprises a resilient material having a plurality of connector elements extending there through for electrically coupling the first contact member and the second contact member.

33. The elastomeric connector assembly as claimed in claim 32, wherein the first contact member comprises a first contact element electrically coupled to the first electronic component and the second contact member comprises a second contact element electrically coupled to the second electronic component, the first contact element and second contact element being positioned to be electrically connected by a connector element of the elastomeric connector.

34. The elastomeric connector assembly as claimed in claim 32, wherein the resilient material comprises silicone and the plurality of connector elements comprise one of carbon, silver, and gold.

35. The elastomeric connector assembly as claimed in claim 25, wherein at least one of the first contact member and the second contact member comprises a flexible circuit.

36. The elastomeric connector assembly as claimed in claim 35, further comprising a support for supporting the flexible circuit.

* * * * *